US005685829A

United States Patent [19]

Allen

[11] Patent Number: 5,685,829

[45] Date of Patent: Nov. 11, 1997

[54] HAND OPERATED HYDRO-THERAPY DEVICE

[76] Inventor: Winston E. Allen, 4 Burritts Landing, Westport, Conn. 06880

[21] Appl. No.: 395,899

[22] Filed: Feb. 28, 1995

Related U.S. Application Data

[63] Continuation-in-part of Ser. No. 256,691, Jul. 20, 1994, abandoned, Ser. No. 79,214, Jun. 21, 1993, abandoned, and Ser. No. 830,118, Jan. 31, 1992, abandoned.

[51] Int. Cl.[6] ..... A61H 9/00; A61H 33/00; B05B 9/00

[52] U.S. Cl. ..... 601/160; 601/161; 239/446; 239/530

[58] Field of Search ..... 601/160, 161; 239/446, 530, 541

[56] References Cited

U.S. PATENT DOCUMENTS

| | | | |
|---|---|---|---|
| 1,807,900 | 6/1931 | Dougherty | 4/615 X |
| 3,072,345 | 1/1963 | Lennon | 239/541 X |
| 3,112,073 | 11/1963 | Larson et al. | 239/446 |
| 3,461,870 | 8/1969 | Van Linge | 4/597 X |
| 3,471,872 | 10/1969 | Symmons | 4/601 X |
| 4,219,162 | 8/1980 | Dadson | 239/583 |
| 4,242,201 | 12/1980 | Stephens et al. | 4/615 X |
| 4,793,331 | 12/1988 | Stewart | 601/160 |
| 4,901,927 | 2/1990 | Valdivia | 4/601 X |
| 5,070,553 | 12/1991 | Chambers | 4/597 X |
| 5,174,503 | 12/1992 | Gasaway | 239/588 X |

*Primary Examiner*—Danton D. DeMille
*Attorney, Agent, or Firm*—James J. McKeever

[57] ABSTRACT

A hydro-therapy device for use with home or club showers and physical therapist which consists of a flexible hose to connect to a diverter valve that is in turn connected to a water source. A shower head of choice is also connected to the diverter valve so that the user mat select a regular shower or a hydro-therapy treatment to a selected portion of his body. The control nozzle of the present invention is connected to the other end of the flexible hose. The control nozzle is what creates the hydro-therapy high pressure single stream of water. The user simply places the diverter valve in the hydro-therapy position, points the control valve at that part of the body that he wishes to treat and slide the on/off switch to the on position and the treatment begins.

1 Claim, 5 Drawing Sheets

HAND OPERATED HYDRO-THERAPY DEVICE

CROSS REFERENCE TO RELATED APPLICATIONS

This application is a Continuation in Part of my U.S. patent application Ser. No. 08/256,691, filed 20 Jul. 1994, now abandoned, and a Continuation in Part of Ser. No. 08/079,214 filed 21 Jun. 1993 and Ser. No. 830,118 filed 31 Jan. 1992, both of which are now abandoned.

FIELD OF THE INVENTION

The present invention relates to the field of hydro-therapy, wherein the device of the present invention produces a single stream of pressurized water, that may be directed to any specific location of the body.

BACKGROUND OF THE INVENTION

The following art has been found to be related to the field of the present invention but in no way does any of the herein cited references anticipate or even suggest the novel single stream of pressurized water that is delivered by the device of the present invention.

U.S. Pat. No. 3,072,345, issued to R. J. Lennon on 8 Jan. 1963, entitled Hose Nozzle, discloses garden hose nozzle diffusor that produces a spray and said nozzle can be operated and controlled by a thumb actuator, there is not even the slightest suggestion of the device of the present invention, a hand operated and directed hydro-therapy, single stream jet for use on the body.

U.S. Pat. No. 5,070,553, issued to K. A. Chambers on 10 Dec. 1991, entitled Shower Head Assembly, discloses a multi component shower head assembly that is adapted to hold filtration material for filtering the water, as above, there is not even the slightest suggestion of the device of the present invention, a hand operated and directed hydro-therapy, single stream jet for use on the body.

U.S. Pat. No. 4,793,331, issued to C. F. Stewart on 27 Dec. 1988, entitled Shower Flossing System, discloses a shower head attachment that may be used to floss teeth while taking a shower, as above, there is not even the slightest suggestion of the device of the present invention, a hand operated and directed hydro-therapy, single stream jet for use on the body.

U.S. Pat. No. 3,112,073, issued to C. B. Larson on 26 Nov. 1963, et al, entitled Flexible Spout Rinsing Head for Shower Baths, U.S. Pat. No. 3,471,872, issued to P. C. Symmons, on 14 Oct. 1969, entitled Plumbing Fixture for Baths and U.S. Pat. No. 2,215,000, issued to S. Isenberg, entitled Apparatus for Treating Shower Sprays. All three are even further removed from the hydro-therapy device of the present invention.

OBJECTS OF THE INVENTION

The object of the present invention is to provide a hydro-therapy device that produces a high pressure single stream of water to any desired part of the body.

Another object of the present invention is to provide a hydro-therapy device, as above, that is hand operated and may be used at home, at a club or any location where a good water supply is located.

A further object of the present invention is to provide a hydro-therapy device, as above, hand regulated and hand directed, producing a high pressure single stream of water.

Various other objects, advantages and features of the present invention will become apparent to those skilled in the an from the previous and following discussions, taken in conjunction with the accompanying drawings, which constitute part hereof.

SUMMARY OF THE INVENTION

The present invention relates to a device for hydro-therapy. More particularly, the present invention pertains to a device for hydro-therapy which is adapted to be used in a home shower, a club or for use in a clinical environment by a professional hydro-therapist.

The medical profession has long recognized the advantageous benefits which can be derived from the application of hydro-therapy. For example, it is common practice for a medical professional to treat a patient having a muscle strain by placing the effected portion of the body in a whirlpool bath. The massaging action of the moving water in the whirlpool bath relaxes the muscles and promotes blood circulation. In this type of hydro-therapy, the affected potion of the body is immersed in a bath, where jets of pressurized air may be directed toward the affected portion of the body, in order to obtain the massaging action. However, the whirlpool type of hydro-therapy requires that a person who receives the treatment must place, at least, that affected portion of the body into said bath. Thus, such hydro-therapy is not desirable since it requires a jet fitted tub and many times it is very difficult to present particular portions of the body to the jets.

The present invention is intended to overcome all of the presently undesirable drawback requirements that are necessary with the presently existing treatments. The device of the present invention consists of a hollow elongated housing member, which has a first entrance end and a second exit end. Said hollow housing is effective for the passing of a flow of pressurized water. Conduiting means are provided for conduiting the flow of pressurized water from a water supply from the entrance end to the exit end. The single stream is produced by the internal valve, which is operated by an on-off-water flow regulator slideably mounted switch mounted on the outside wall of said hollow housing located near the exit end.

The single stream of pressurized water is much more effective for hydro-therapy than the presently available pulseable water stream. In accordance with the preferred embodiment of the present invention, a simple one-handed operation is all that is necessary to effect the control of the single stream exit flow and the ability to direct said single stream of pressurized water flow to the specific portion of the body where it is needed.

Diverting means may be added to a shower, bath or any other water supply means, so that the device of the present invention, may be added. Any selection means may be used to select between the device of the present invention and the normal water supply. Since there are many different types and sizes of connecting means, various adapting means may be used to adapt the flexible conduiting means, that is connected to the present invention, to wherever water source may be available.

In accordance with the present invention, an apparatus for hydro-therapy, is provided, which allows a user to obtain the benefits of hydro-therapy within the home or at a club. The device of the present invention is also effective for clinical use by a professional. A single stream of pressurized water is provided, which may be directed to and at various portions of the body, at which the benefits of hydro-therapy is desired. The flow rate may be varied selectively by the operator and as a result, the impact strength of the single stream may be varied throughout the use of the device of the present invention. The flexibility of the use of the device of the present invention allows for a number of alternative methods of hydro-therapy. For Example, a user or operator may desire to introduce a menthol or any other type of soothing medication into the single stream that is produced by the device of the present invention. All that is needed is to introduce a medication containing reservoir, in line, between the water source and the device of the present invention, at either end of the flexible conduiting means. The temperature of the pressurized single stream of water produced by the device of the present invention may be varied simply by varying the water temperature at the water source. In addition, alternative applications of hot and cold water streams may be applied by varying the temperature thereof at the water source.

DETAILED DESCRIPTION OF THE PREFERRED EMBODIMENT OF THE PRESENT INVENTION

Figure 1:
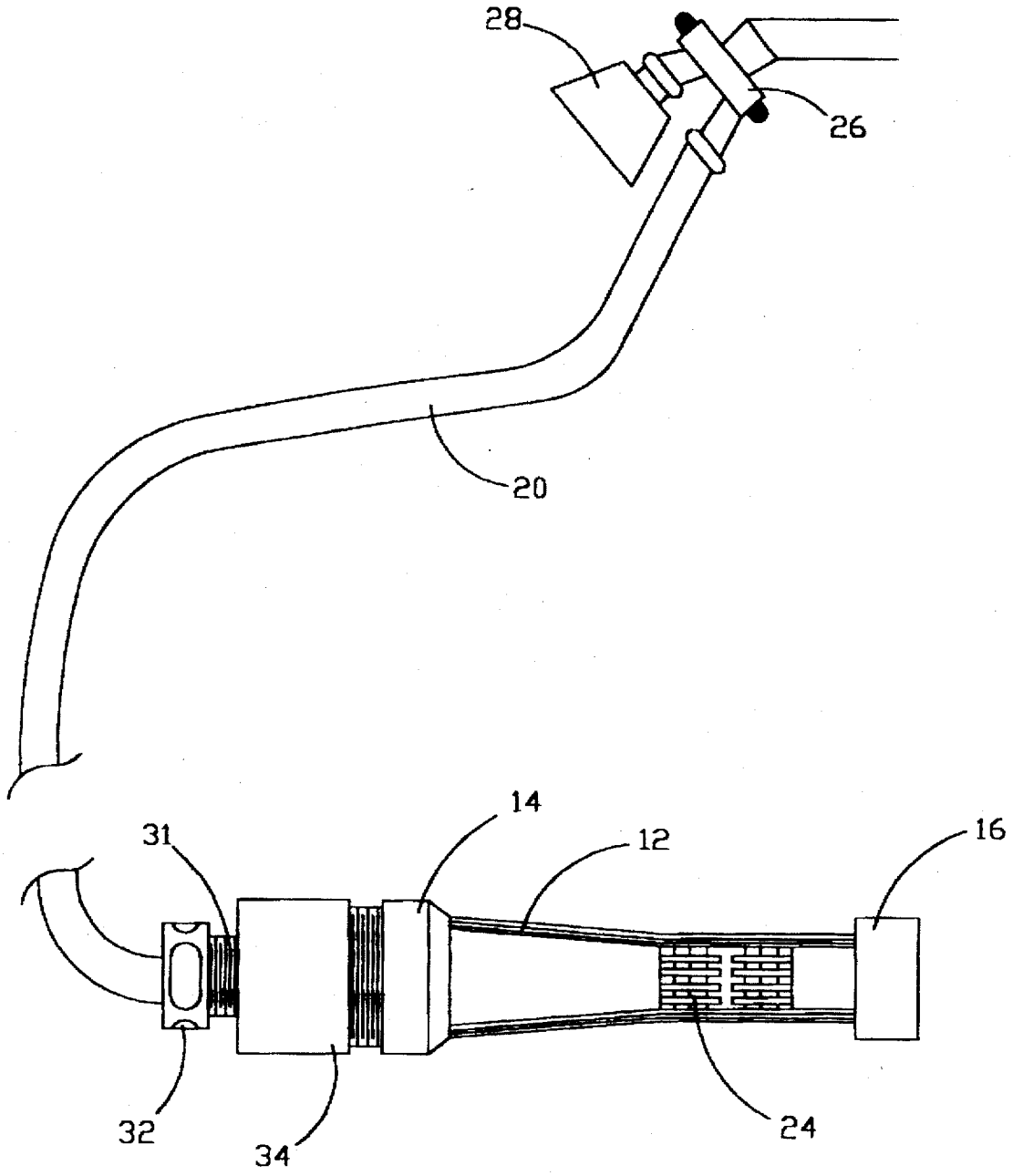
FIG. 1. is a plan view of the device of the present invention showing it connected to a water source.

Referring now to FIG. 1, wherein the hydro-therapy device of the present invention which is shown in a plan view and in which an elongated hollow housing is shown at 12, that is provided with an entrance end 14 and an exit end 16. Said hollow housing is effective for passing a pressurized flow of water from said entrance end 14 through said exit end 16. Alternatively, said elongated hollow housing 12 may be provided with ridges running the length of said hollow housing, to facilitate better gripping when being used with soap and water in the shower. Flexible conduiting means 20, is provided to carry pressurized water from diverter 26 and water source 10 to said hollow housing 12, through female coupling connector 32, double-ended female pipe connector 31 and double ended, male and female connector 34. Said hollow housing 12, is provided with a thumb operated on-off-water flow switch 24 and said exit end 16 of said hollow housing 12 is provided with end cap 30.

Said diverter valve 26 provides pressurized water flow to either a shower head 28 or to said flexible conduiting means 20.

Figure 2:
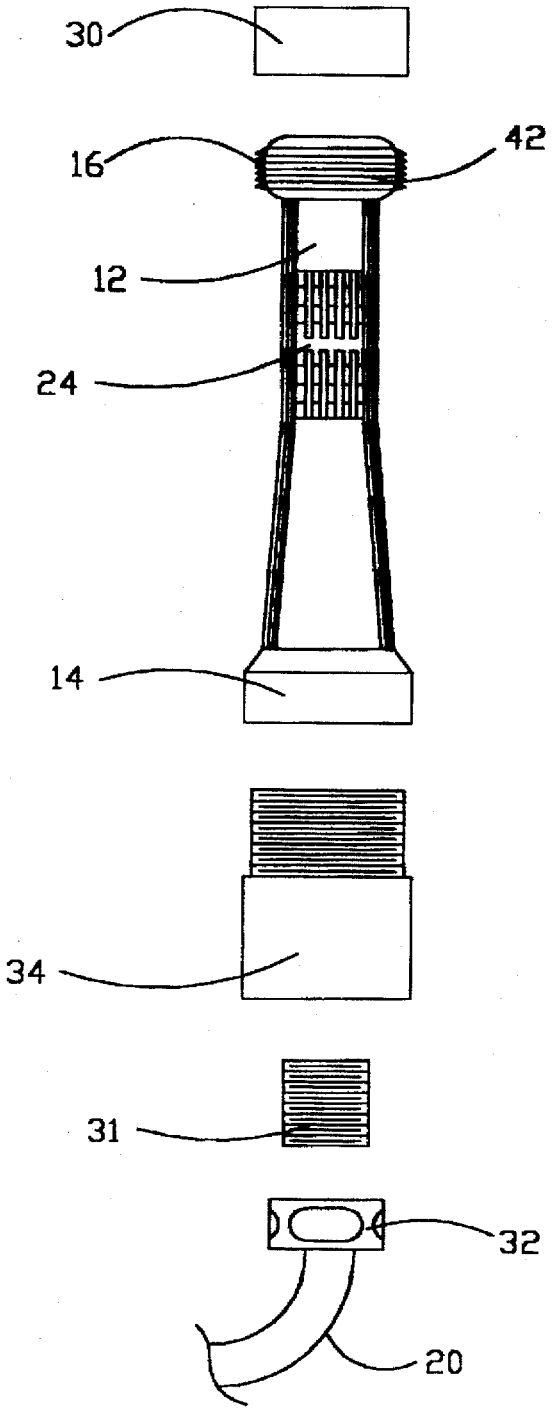
FIG. 2. is an exploded planned view of the various components of the device of the present invention without the shower head assembly.

In FIG. 2, the individual parts of the device of the present invention are shown in an exploded view wherein, 20 is the flexible conduiting means, 32 is a female coupling connector, 31 is the double ended female pipe connector, 34 is the double ended, male and female connector, 14 is the entrance end of said hollow housing 12, 24 is the thumb on-off-water flow switch, 16 is the exit end of 12 and 42 is the threads provided for end cap 30.

Figure 3A:
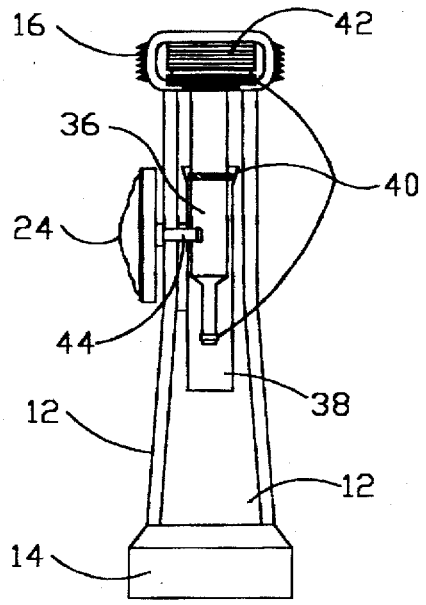
FIG. 3*a*. is a cut-away view of the nozzle portion of the device of the present invention taken on a center line of the nozzle as shown in FIG. 1, with the valving means in the flow-off position.
Figure 3B:
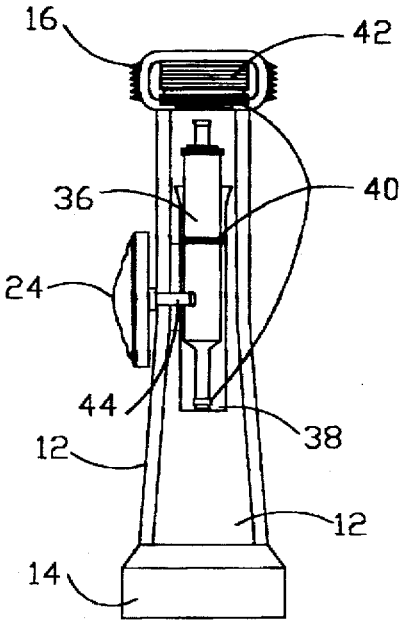
FIG. 3*b*. is a cut-away view of the nozzle portion of the device of the present invention taken on a center line of the device as shown in FIG. 1. with the valving means in the flow-on operating position.

FIGS. 3*a* and 3*b* shows the device of the present invention, in a sectional view, on a center-line of the device of the present invention as it appears in FIG. 1, on a water-on and in a water-off position respectively, wherein is the entrance end 14 of hollow housing 12, 38 is the valve housing for valve piston 44, 24 is the on-off-water flow switch, 36 is the connector between switch 24 and valve piston 44 in valve housing 38, valve piston is fitted with various O-ring sealers at 40 and exit end 16 is shown with threads for end cap 30.

Figure 4:
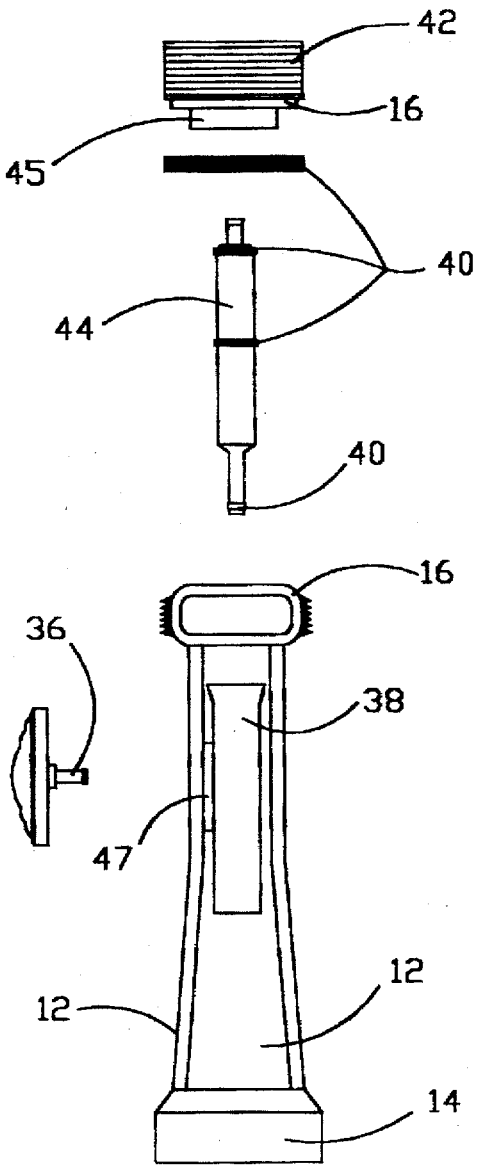
FIG. 4. is an exploded view of the valving means of the device of the present invention.
Figure 5:
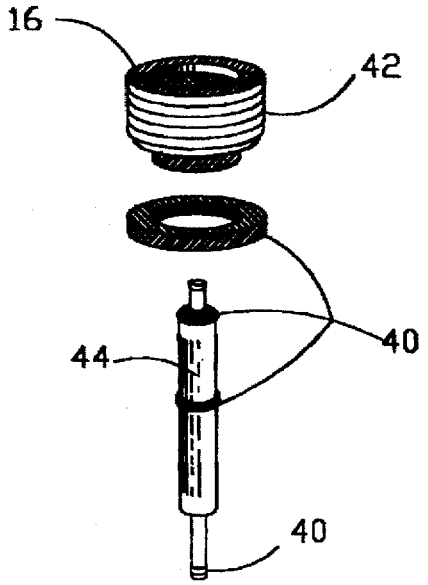
FIG. 5. is an exploded view of the valve itself.

FIG. 4 is an exploded sectional view of the valve system of the device of the present invention, which consists of valve piston 44, valve housing 38, switch 24, connector 36 and O-rings 40, wherein said internal valve system is shown with guide cut-out 47 on valve housing 38 is provided to accept connector 36 on thumb switch 24. In the view of valve housing 44, the O-rings are at 40, the valve piston is at 44, the valve seat is at 45 and the threads 42 for end cap 30 are at exit end 16.

Figure 6A:
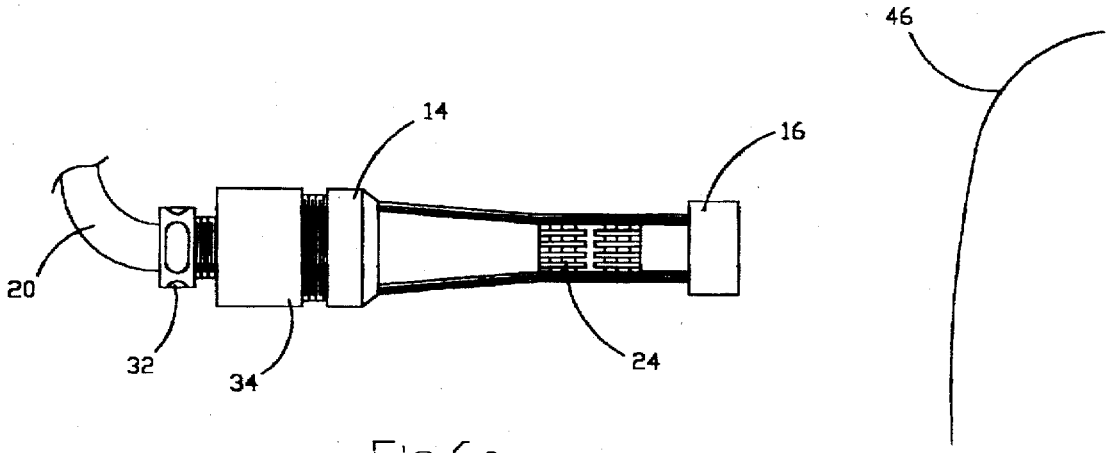
FIG. 6*a*. is an isolated view of the device of the present invention in the flow-off position ready for use.
Figure 6B:
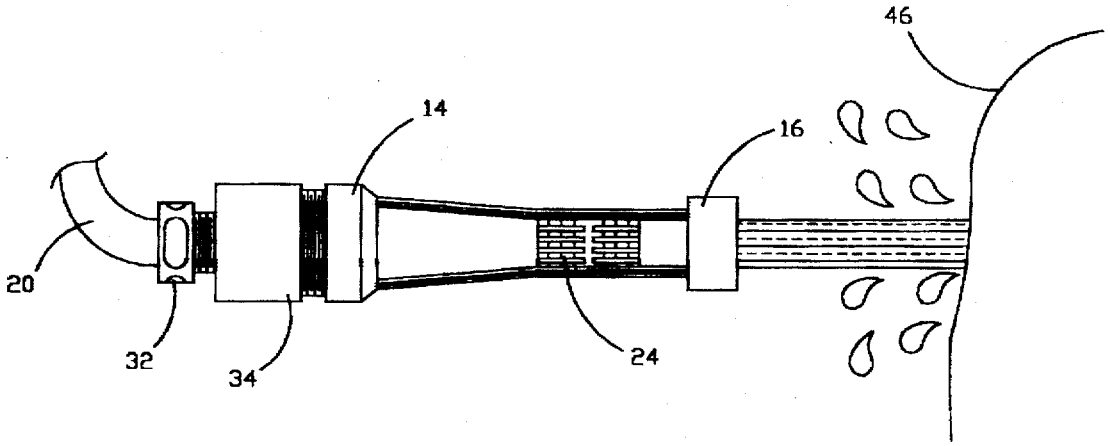
FIG. 6*b*. is an isolated view of the device of the present invention in the flow-on position, showing the single stream of pressurized water impacting a portion of a user's body.

FIGS. 6*a*. and 6*b*. show the device of the present invention, with it in the closed (water off) portion in FIG. 6*a*. and in the open and operating (water on) position on FIG. 6*b*., wherein said flexible conduit housing is at 20, said pipe connections are at 32 and 34, connected to entrance end 14 of hollow housing 12. In FIG. 6*a*., thumb switch 24 is in the closed (water off) position and no water is emitting from the device of the present invention to the treating body 46. In FIG. 6*b*., thumb switch is in the open (operating) position with pressurized water striking the selected portion of body 46.

In actual use the device of the present invention is connected to a flexible hosing 20, through pipe connector 31, 32, and 34. Flexible hosing 20 is in turn connected to a diverter valve 26, which allows the user to select to take a shower or to conduct hydro-therapy on a selected part .of the body 46. This is accomplished by actuating diverter valve 26 to shower head 28 or to flexible hosing 20.

When diverter valve 26 is connected to a water source 10 and the user selects flexible hose 20 by said valve 26, the user grasps said elongated hollow housing 12 in one hand, directs the exit end 16 at that portion of the body that is to be treated and moves the thumb switch 24 to the open and operating position, causing a full pressure or less single stream of treating water to exit the device of the present invention. Hydro-Therapy begins as shown in FIG. 6*b*. The water source may be regulated between cold and to any higher temperature as desired, by normal means.

While the above description contains many specificities, the reader should not construe these as limitations on the scope of the invention, but merely as exemplification of a preferred embodiment. Those skilled in the art, will envision that many other possible variations are within the scope of the present invention. For example, skilled artisans will readily be able to change the dimensions and the materials of the various embodiments. They can make variations on the design of the present invention. Accordingly, the reader is requested to determine the scope of the present invention by the scope of the appended claims and their legal equivalents, and not by the examples that have been given herein.

What is claimed is:

1. A portable device for performing personal hydrotherapy with a single stream of pressurized water comprising:

an elongated hollow housing, said housing having an entrance end and an exit end for the water, said housing further effective in passing a flow of pressurized water therethrough, said entrance end connected through a plurality of plumbing pipe connections to a flexible conduit means; said flexible conduit means connected to a diverter valve; said diverter valve provided with an alternate diverter capable of selectively directing pressurized water to a shower head or said flexible conduit means, said diverter valve connected to a pressure water source;

said elongated hollow housing is provided with a thumb switch, located on the outside wall surface of said elongated hollow housing, said thumb switch connected through a longitudinal opening in said housing to a piston in a centrally positioned piston housing inside said elongated hollow housing, said piston housing having a circular cross section supported in a spaced central location allowing the free flow of water all around the outside of the piston housing, said hollow housing exit end having an opening shaped to concentrate water exiting the housing into a single stream of pressurized water, said piston having an exit end which includes a portion which enters the hollow housing exit end opening for controlling the single stream of pressurized water, said piston having an O-ring on said exit end for sealing with the opening in the hollow housing exit end said piston having two additional O-rings for sealing the central portion of the piston housing from water, said piston in said piston housing is connected to said thumb switch that is adapted to being placed in an off position, a fully on position or anywhere in between by the movement of said thumb switch, said portion of the exit end of the piston moves within the hollow housing exit end opening to control the size and force of the pressurized water flow out the exit end of the hollow housing thereby producing a pressurized single stream of hydro-therapeutic water in a force of from about 40 to about 85 ppi to whatever location on the body of the user that may be desired.

* * * * *